US005475953A

United States Patent [19]

Greenfield

[11] Patent Number: 5,475,953

[45] Date of Patent: Dec. 19, 1995

[54] 2-SHAPED EDGE MOLDING STRIP

[75] Inventor: Sherwood S. Greenfield, Charlotte, N.C.

[73] Assignee: Powerflor, Inc., Charlotte, N.C.

[21] Appl. No.: 314,855

[22] Filed: Sep. 29, 1994

[51] Int. Cl.[6] ..... E04F 11/16

[52] U.S. Cl. ..... 52/179; 52/287.1; 52/717.03; 52/717.05

[58] Field of Search ..... 52/717.03, 717.05, 52/287.1, 179

[56] References Cited

U.S. PATENT DOCUMENTS

| | | | |
|---|---|---|---|
| 960,489 | 6/1910 | Braun | 52/179 |
| 2,377,994 | 6/1945 | Cocken, Jr. . | |
| 2,593,683 | 4/1952 | Lyons . | |
| 2,733,475 | 2/1956 | McMeans . | |
| 2,750,621 | 6/1956 | White . | |
| 3,090,087 | 5/1963 | Miller . | |
| 3,099,336 | 7/1963 | Hawkins . | |
| 3,811,237 | 5/1974 | Bettinger . | |
| 3,942,295 | 3/1976 | Schacht | 52/717.05 X |
| 4,069,542 | 1/1978 | Carder . | |
| 4,285,177 | 8/1981 | Seegers . | |
| 4,478,017 | 10/1984 | Brown et al. . | |
| 4,561,232 | 12/1985 | Gladden, Jr. et al. . | |
| 4,598,516 | 7/1986 | Groshong . | |
| 4,676,036 | 6/1987 | Bessert . | |
| 4,837,889 | 6/1989 | Saotome . | |
| 5,031,369 | 7/1991 | Kobayashi et al. . | |
| 5,205,087 | 4/1993 | Jines . | |
| 5,289,663 | 3/1994 | Schlüter | 52/717.03 X |

FOREIGN PATENT DOCUMENTS

| | | | |
|---|---|---|---|
| 2096665 | 10/1982 | United Kingdom | 52/287.1 |

*Primary Examiner*—Carl D. Friedman
*Assistant Examiner*—W. Glenn Edwards
*Attorney, Agent, or Firm*—W. Thad Adams, III

[57] ABSTRACT

An edge molding strip is provided for being located at the transition between first and second floors of different heights. The edge molding strip includes a cap segment for residing adjacent to the surface of the first floor. The cap segment covers an edge of a flooring material carried by the first floor. A connecting web is secured at one end thereof to the cap segment. The connecting web extends downwardly from the cap segment to the surface of the second floor. The connecting web resides adjacent to a raised section of flooring located between the first floor and the second floor.

12 Claims, 2 Drawing Sheets

2-SHAPED EDGE MOLDING STRIP

TECHNICAL FIELD AND BACKGROUND OF THE INVENTION

This invention relates to an edge molding strip for being located at the transition between first and second floors of different heights. The invention is used, for example, in computer rooms and other rooms including electrical items and work stations. These such rooms are typically raised to permit passage of underfloor cables, and generally have a step-down area when leaving the room. The present invention provides a transition between these two floor levels.

The invention addresses problems associated with the covering material of the raised floor. In the case of carpet, for example, the invention serves to cover the edge of the carpet at the transition between floors, and prevents the carpet from unraveling, fraying, or rolling-up at the edges. These conditions are not only aesthetically displeasing, but may lead to injury and legal liability due to trip and fall accidents. In the case of wood floors or tiles, the invention protects the edge of flooring from chipping, splintering, and other such damage.

In addition, the invention is relatively inexpensive and easy to install. The invention provides an aesthetically pleasing appearance to the raised floor, and functions to protect the flooring material and increase the overall safety of the area as people step between floors.

SUMMARY OF THE INVENTION

Therefore, it is an object of the invention to provide a edge molding strip for being located at the transition between first and second floors of different heights.

It is another object of the invention to provide an edge molding strip which increases the overall safety of the area as people step between adjacent floors.

It is another object of the invention to provide an edge molding strip which has an aesthetically pleasing appearance when installed.

It is another object of the invention to provide an edge molding strip which protects the flooring material of the raised floor from unraveling, fraying, or rolling-up at the edges.

It is another object of the invention to provide an edge molding strip which protects the flooring material of the raised floor from chipping and splintering.

It is another object of the invention to provide an edge molding strip which is relatively inexpensive.

It is another object of the invention to provide an edge molding strip which is relatively easy to install.

These and other objects of the present invention are achieved in the preferred embodiments disclosed below by providing an edge molding strip for being located at the transition between first and second floors of different heights. The edge molding strip includes a cap segment for residing adjacent to the surface of the higher first floor. The cap segment covers an edge of a flooring material carried by the first floor. A connecting web is secured at one end thereof to the cap segment. The connecting web extends downwardly from the cap segment to the surface of the second floor. The connecting web resides adjacent to a raised section of flooring located at the transition between the higher first floor and the lower second floor.

According to one preferred embodiment of the invention, a base segment is carried by a second end of the connecting web. The base segment extends outwardly from the connecting web opposite the direction of the cap segment for residing adjacent to the surface of the lower second floor.

According to another preferred embodiment of the invention, the cap segment and the base segment are integrally formed with respective first and second ends of the connecting web.

According to yet another preferred embodiment of the invention, the thickness of the cap segment tapers from a proximal end thereof to a distal end thereof, and thereby defines an area of increased rigidity at the junction of the connecting web and the cap segment.

According to yet another preferred embodiment of the invention, the thickness of the base segment tapers from a proximal end thereof to a distal end thereof, and thereby defines an area of increased rigidity at the junction of the connecting web and the base segment.

According to yet another preferred embodiment of the invention, the edge molding strip is constructed of a heavy-duty plastic material.

According to yet another preferred embodiment of the invention, the edge molding strip is constructed of aluminum.

According to yet another preferred embodiment of the invention, the edge molding strip is constructed of rubber.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
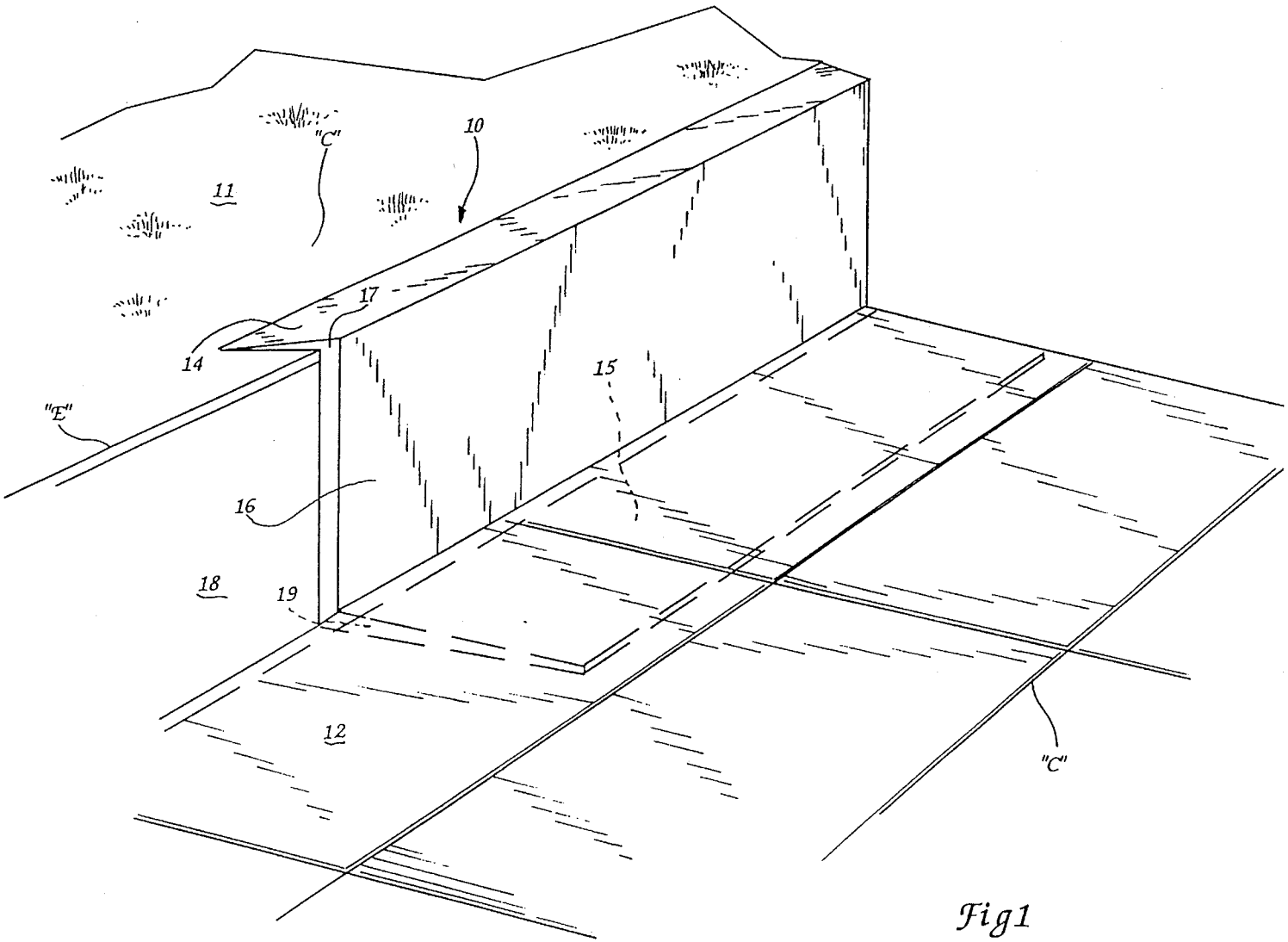
FIG. 1 is an environmental perspective view of the invention according to one preferred embodiment, and showing a section of the edge molding strip positioned at the transition between two floor levels of different heights.

Referring now specifically to the drawings, an edge molding strip according to the present invention is illustrated in FIG. 1 and shown generally at reference numeral 10. The edge molding strip 10 is located at the transition between first and second floors, 11 and 12, of different heights. For example, floors in computer rooms which are raised to permit passage of under-floor cables generally have a step-down area when leaving the room. The edge molding strip 10 provides a transition between these two floor levels. Preferably, the edge molding strip 10 is installed in one or more sections to accommodate the entire perimeter area of the raised first floor 11.

Figure 2:
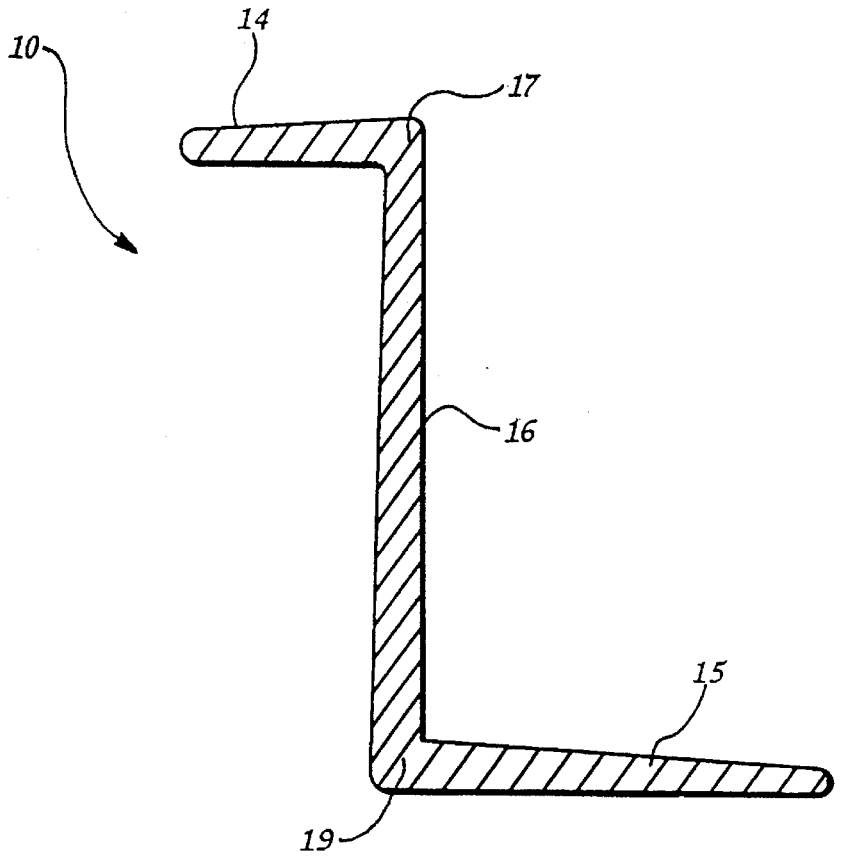
FIG. 2 is a cross-sectional view of the edge molding strip shown in FIG. 1.

As shown in FIGS. 1 and 2, the edge molding strip 10 includes a cap segment 14, a base segment 15, and a connecting web 16 interconnecting the cap and base segments, 14 and 15, together. Preferably, the cap segment 14 and the base segment 15 are integrally formed with the first and second ends of the connecting web 16. Thus, the edge molding strip 10 is preferably "S"-shaped or "Z"-shaped.

The cap segment 14 extends along the edge of the higher first floor 11, and serves to cover the edge "E" of flooring material, such as carpeting "C". The cap segment 14 prevents the carpet "C" from unraveling, fraying, or rolling-up at the edges. These conditions are not only aesthetically displeasing, but may cause injury due to trip and fall accidents.

As best shown in FIG. 2, the cap segment 14 is preferably angled slightly inward to create tension for holding the cap segment 14 down firmly on the carpet "C" when the edge molding strip 10 is installed. The thickness of the cap segment 14 preferably tapers from the connecting web 16 to further reduce the likelihood of trip and fall accidents. The resulting area of increased thickness and rigidity at the junction 17 of the cap segment 14 and connecting web 16 increases the life and durability of the edge molding strip 10.

The connecting web 16 extends perpendicularly downwardly from the cap segment 14 to the lower second floor 12, and resides adjacent to a raised section of flooring 18 located between the first floor 11 and the second floor 12 when the edge strip molding 10 is installed. The height of the connecting web 16 is dependant upon the distance between the surfaces of the first and second floors, 11 and 12.

The base segment 15 extends outwardly from the connecting web 16 in a direction opposite the direction of the cap segment 14, and resides adjacent to the surface of the lower second floor 12. Preferably, the base segment 15 is positioned beneath flooring material, such as carpeting "C" of the second floor 12. The base segment 15 may be adhered to the subfloor of the lower second floor 12 by any suitable adhesive, such as rubber cement.

In addition, the thickness of the base segment 15 preferably tapers from the connecting web 16 to define an area of increased rigidity and thickness at the junction 19 of the base segment 15 and the connecting web 16. This added thickness increases the durability and life of the edge molding strip 10.

According to one preferred embodiment of the edge molding strip 10, the depths of the cap segment 14 and base segment 15 from the connecting web 16 are 1.0 inch and 2.0 inches, respectively. The proximal ends of the cap segment 14 and base segment 15 are each 0.10 inches thick. The distal ends of the cap segment 14 and base segment 15 are each 0.03 inches thick. The thickness of the connecting web 16 is 0.125 inches.

In an alternative embodiment (not shown), the edge molding strip 10 does not include a base segment 15. Instead, the cap segment 14 and connecting web 16 are adhered, respectively, directly to the first floor 11 and raised flooring section 18. In addition, the edge molding strip 10 may be constructed of a heavy-duty plastic material, such as ABS flame-retardant plastic, extruded aluminum, or rubber.

An edge molding strip is described above. Various details of the invention may be changed without departing from its scope. Furthermore, the foregoing description of the preferred embodiment of the invention is provided for the purpose of illustration only and not for the purpose of limitation-the invention being defined by the claims.

I claim:

1. An edge molding strip for being located at the transition between first and second floors of different heights, said edge molding strip comprising:

(a) a cap segment for residing adjacent to the surface of the higher first floor, and for covering an edge of a flooring material carried by the first floor;

(b) a connecting web secured at one end thereof to said cap segment, and extending downwardly from said cap segment to the surface of the lower second floor, said connecting web for residing adjacent to a raised section of flooring located between the first floor and the second floor;

(c) a base segment carried by a second end of said connecting web, and extending outwardly from said connecting web opposite the direction of said cap segment for residing adjacent to the surface of the second floor; and (d) said cap segment and said base are integrally formed with respective first and second ends of said connecting web.

2. An edge molding strip according to claim 1, wherein the thickness of said cap segment tapers from a proximal end thereof to a distal end thereof, and thereby defines an area of increased rigidity at the junction of said connecting web and said cap segment.

3. An edge molding strip according to claim 1, wherein the thickness of said base segment tapers from a proximal end thereof to a distal end thereof, and thereby defines an area of increased rigidity at the junction of said connecting web and said base segment.

4. An edge molding strip according to claim 1, wherein the edge molding strip is constructed of a heavy-duty plastic material.

5. An edge molding strip according to claim 1, wherein the edge molding strip is constructed of aluminum.

6. An edge molding strip according to claim 1, wherein the edge molding strip is constructed of rubber.

7. A z-shaped edge molding strip for being located at the transition between first and second floors of different heights, said edge molding strip comprising:

(a) a cap segment for residing adjacent to the surface of the first floor, and for covering the edge of a flooring material carried by the first floor; and (b) a connecting web integrally formed at one end thereof with said cap segment, and extending perpendicularly downwardly from said cap segment to the surface of the second floor, said connecting web for residing adjacent to a raised section of flooring located between the first floor and the second floor; and (c) a base segment integrally formed with a second end of said connecting web, and extending outwardly from said connecting web opposite the direction of said cap segment for residing adjacent to the surface of the second floor.

8. An edge molding strip according to claim 7, wherein the thickness of said cap segment tapers from a proximal end thereof to a distal end thereof, and thereby defines an area of increased rigidity at the junction of said connecting web and said cap segment.

9. An edge molding strip according to claim 7, wherein the thickness of said base segment tapers from a proximal end thereof to a distal end thereof, and thereby defines an area of increased rigidity at the junction of said connecting web and said base segment.

10. An edge molding strip according to claim 7, wherein the edge molding strip is constructed of a heavy-duty plastic material.

11. An edge molding strip according to claim 7, wherein the edge molding strip is constructed of aluminum.

12. An edge molding strip according to claim wherein the edge molding strip is constructed of rubber.

* * * * *